United States Patent [19]

Parker

[11] 4,377,962

[45] Mar. 29, 1983

[54] COLLAPSIBLE BANJO OR LIKE STRINGED INSTRUMENTS

[76] Inventor: Alfred T. Parker, 68 Market Jew St., Penzance, Cornwall, England

[21] Appl. No.: 244,554

[22] Filed: Mar. 17, 1981

[30] Foreign Application Priority Data

Mar. 17, 1980 [GB] United Kingdom ..... 8008994

[51] Int. Cl.[3] ..... G10D 1/10; G10D 3/12

[52] U.S. Cl. ..... 84/269; 84/293; 84/297 R; 84/299; 84/300; 84/308; 84/314 N

[58] Field of Search ..... 84/267, 269, 291, 293, 84/297 R, 299–301, 308, 314 N

[56] References Cited

U.S. PATENT DOCUMENTS

| | | | |
|---|---|---|---|
| 439,230 | 10/1890 | Ximenes | 84/308 |
| 459,414 | 9/1891 | Robinson | 84/297 R |
| 1,567,359 | 12/1925 | De Wick | 84/293 |
| 1,686,416 | 10/1928 | Mietz | 84/269 |
| 2,497,116 | 2/1950 | Dopyera | 84/293 |
| 3,191,480 | 6/1965 | Lowe | 84/314 N |

*Primary Examiner*—Lawrence R. Franklin
*Attorney, Agent, or Firm*—Pollock, VandeSande & Priddy

[57] ABSTRACT

A neck and tailpiece are detachable together with the strings from the body of a banjo for storage and transportation. The banjo can easily be reassembled with very little adjustment. The strings pass through holes in a nut and in a bridge removable with the strings. The neck is attached by screws passing through a heel thereon. Adjustable members are provided for initially setting the angle of the neck relatively to the body. The tailpiece has a screw device that reacts against a slotted bracket. The body comprises a hoop reinforced by an L-shaped flange member.

7 Claims, 6 Drawing Figures

COLLAPSIBLE BANJO OR LIKE STRINGED INSTRUMENTS

BACKGROUND OF THE INVENTION

The invention relates to banjos and like stringed instruments.

The invention is more particularly related to such instruments which can be taken apart and readily reassembled for storage and transportation.

SUMMARY OF THE INVENTION

According to the invention there is provided a collapsible banjo or like stringed instrument having a body, a neck supporting a finger board, and a tail piece, in which the neck is releasably secured to the body and the tailpiece is releasably secured to an anchor part on the body so that the tailpiece and neck can be separated from the body with the strings remaining attached between the neck and tailpiece for storage and transportation.

In the case of a banjo, the body normally comprises a hoop or shell which is preferably stabilized by a metallic flange.

A collapsible banjo according to the invention will now be described.

DESCRIPTION OF THE PREFERRED EMBODIMENT

Figure 2:
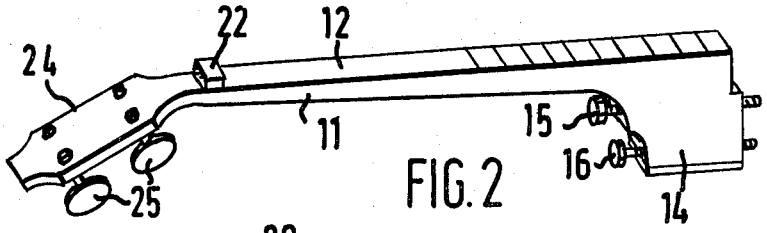
FIG. 2 shows a neck for the banjo.
Figure 1:
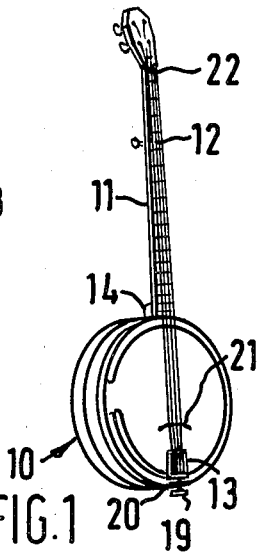
FIG. 1 shows the banjo fully assembled.
Figure 4:
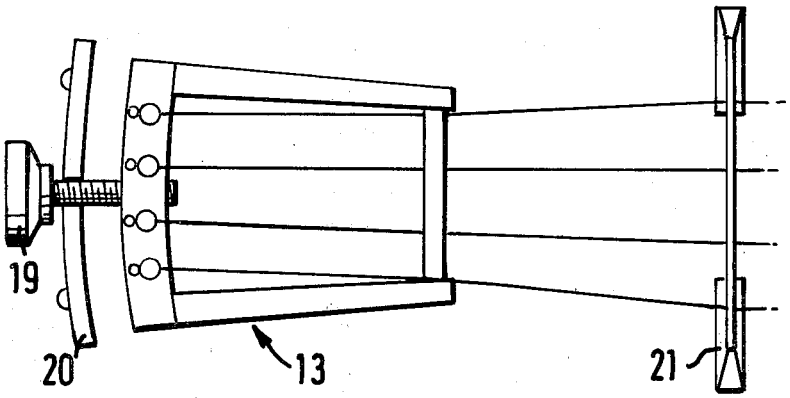
FIG. 4 shows a tailpiece and bridge for the banjo.
Figure 5:
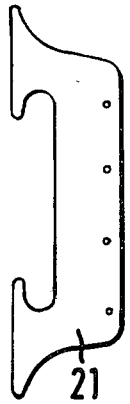
FIG. 5 is a different view of the bridge.

Referring to the drawings, in FIG. 1 the banjo comprises a sound body 10, a neck 11 supporting a finger board 12 and a tailpiece 13. The neck 11 has a peghead 24 with tuning pegs 25 and a heel 14 which is secured to the body 10 by two screws 15 and 16 (see FIG. 2) engaging threaded holes 17 and 18 in the body 10. The tailpiece 13 is secured by a screw 19 to an anchor bracket 20 mounted on the body 10. A bridge 21 is provided with holes for strings of the banjo to pass through and a nut 22 at the top of the finger board 12 likewise has holes for the strings.

To dismantle the banjo the screw 19 is undone and lifted with the tailpiece 13 away from the anchor bracket 20. The screws 15 and 16 are then undone to allow separation of the neck 11 from the body 10. The strings with the bridge 21 and the tailpiece 13 attached can then be folded back over the finger board 12 and packed away in a case (not shown) together with the body 10.

Reassembly is carried out by screwing the neck 11 onto the body and then securing the tailpiece 13 to the anchor bracket 20, positioning the bridge 21 as the nut 19 is tightened up. Reassembly can be very quickly achieved and generally without any substantial loss in tuning. The speed of assembly is much improved using the holed bridge 21 and the holed nut 22 although in other embodiments of the invention grooved bridges and/or grooved nuts may be used.

Figure 3:
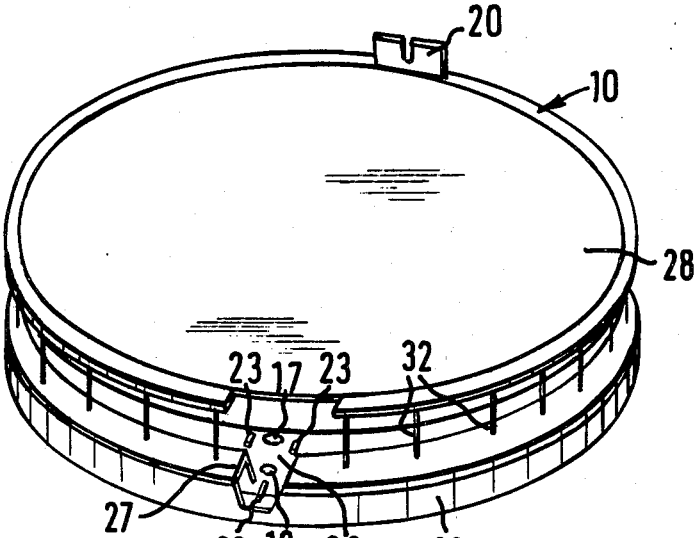
FIG. 3 shows a body of the banjo.

It will be noted that there are three adjustable members 23 (FIG. 3), comprising trapped bolts for example, mounted in and protruding from the body 10. The members 23 cooperate with seating plates (not shown) in the heel 14 so as to set the angle of the neck 11 with respect to the body 10, when the heel 14 is pulled up by the screws 15 and 16 to secure the neck 11 to the body 10. Preferably, there are three members 23 in a triangular array but the relative angle could be set in one plane at least by providing only two members. Further, it will be appreciated that more than three members 23 could be used to set the relative angle if desired.

Figure 6:
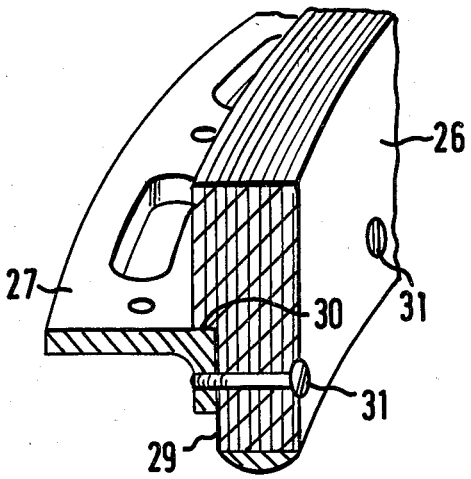
FIG. 6 is a sectional perspective view of a detail of the banjo.

A perch pole or stabilizing rod is normally provided in a conventional banjo which is an extension of the neck and extends across the body 10. In embodiments of the present invention, it is usual to provide an alternative form of stabilizing structure for the body 10. Preferably, the body 10, which comprises a hoop or shell 26 in a banjo, includes a metallic stabilizing flange 27 which extends around the outside of the hoop 26. The flange 27 is generally a cast L-shaped flange (FIG. 6) in cross-section and circular in plan and fits generally intermediate the outside surface of the hoop or shell. The outside diameter of the hoop 26 is reduced by around 3 mm in a rebate 29 allowing the flange to slide up over the hoop from the bottom and bear against a ridge 30. The hoop is bolted by bolts 31 to the hoop and its outward extending part locates ties 32 to tension down the vellum 28 of the banjo on which the bridge 21 sits. The outward extending part is also used to support a resonator 33 at the base of the body 10. The outward extending part is cut-away to allow the neck 11 to be positioned against the hoop 26 as required.

Embodiments of the invention may comprise guitars, in which case the anchor part for the tailpiece comprises an anchoring point or apertures positioned more centrally in the body of the guitar and the tailpiece 13 is arranged to cooperate with and be releasably secured to said anchoring point or in said apertures.

At present banjos and like stringed instruments cannot be taken apart and reassembled by users. The invention therefore enables such instruments to be conveniently stored or transported when not in use in a relatively small rectangular case, for example. Such cases are generally more easily handled and are less obtrusive. Because, in preferred embodiments the bridge 21 and nut 22 are holed and not grooved, assembly is quick and simple. Further, the screws 15 and 16 are readily accessible, being below the neck 11 and not inside the body in preferred embodiments, to the user for disassembly or assembly.

The members 23 may be omitted where the heel 14 and body 10 are provided with cooperating faces which are suitably angled and when brought together provide a correct set angle between the neck 11 and the body 10. Also, the screws 15 and 16 may be replaced by clamping means if desired.

I claim:

1. A collapsible stringed instrument to be played manually comprising a sound-body presenting a substantially flat upper surface and a peripheral wall extending downwards from said surface, an elongated neck extending substantially radially from said wall and formed with a peghead at the end thereof remote from said sound-body, the other end of said elongated neck being formed with a heel bearing on said wall, screw means accessible from beneath said neck for detachably securing said heel to said wall by tightening said screw means whereby said neck can be detached from said wall by removing said neck radially therefrom when said screw means are released, a finger board on said neck substantially coplanar with said flat upper surface of said sound-body, a plurality of tuning pegs in said pegboard for tensioning strings when respectively attached thereto, strings respectively attached to said pegs, an anchor bracket fixed to said sound-body at a location in axial alignment with said elongated neck on a portion of said sound-body remote from said neck, a tailpiece attached to all said strings at the ends thereof remote from said pegs, screw means mounted on said tailpiece for drawing said tailpiece to said anchor bracket and for ready removal from said bracket while remaining engaged with said tailpiece, and a bridge removably resting on said flat upper surface of said sound-body between said neck and said tailpiece and formed with holes through which said strings respectively pass, whereby the assembly consisting of said neck, tailpiece, bridge and strings can be separated as a unit from said sound-body without slackening said strings and then mounted on said sound-body with said strings already in tune.

2. A collapsible stringed instrument according to claim 1 wherein said instrument is a banjo, said sound-body comprising a circular hoop, a circular L-section member fitted around the outside of said hoop and fixed to said hoop with one flange of said member bearing against said hoop and the other flange of said member extending outwardly from said hoop, a vellum extending over said hoop, ties for tensioning down said vellum, said ties interconnecting said outwardly extending flange and said vellum, and a resonator supported by said outwardly extending flange.

3. A collapsible stringed instrument according to claim 1, wherein said wall comprises a reinforcing shell for said sound-body.

4. A collapsible stringed instrument according to claim 1, including at least two adjustable members mounted between said neck and said wall for setting the relative angle of said neck with respect to said sound-body when said neck is secured to said sound-body.

5. A collapsible stringed instrument according to claim 4, wherein there are three of said adjustable members respectively on parallel axes extending radially through said wall in a triangular array.

6. A collapsible stringed instrument according to claim 1, wherein said anchor part is a member formed with an open-ended slot and said tailpiece includes a primary portion connected to said strings and mounted between and spaced from said anchor member and said bridge and also includes a threaded rod passing through said slot, said screw means being operative to draw said rod through said slot and said primary portion towards said slotted member.

7. A collapsible stringed instrument according to claim 1, including a nut mounted on said neck adjacent said pegboard and formed with holes through which said strings respectively pass.

* * * * *